US005107165A

United States Patent [19]

Dever et al.

[11] Patent Number: 5,107,165

[45] Date of Patent: Apr. 21, 1992

[54] INITIAL LIGHT OUTPUT FOR METAL HALIDE LAMP

[75] Inventors: Timothy P. Dever, Fairview Park; Gary R. Allen, Chesterland; John M. Davenport, Lyndhurst; Gerald E. Duffy, Mentor, all of Ohio

[73] Assignee: General Electric Company, Schenectady, N.Y.

[21] Appl. No.: 608,084

[22] Filed: Nov. 1, 1990

[51] Int. Cl.[5] ..... H01J 1/02; H01J 17/04; H01J 17/20

[52] U.S. Cl. ..... 313/25; 313/44; 313/45; 313/46; 313/113; 313/632; 313/331

[58] Field of Search ..... 313/25, 44, 45, 46, 313/113, 631, 632, 634, 623, 331, 332, 39

[56] References Cited

U.S. PATENT DOCUMENTS

| | | | |
|---|---|---|---|
| 2,667,592 | 1/1954 | Hilder | 313/39 |
| 3,248,586 | 4/1966 | Schlegel | 313/39 |
| 4,906,895 | 3/1990 | Pabst et al. | 313/632 |
| 4,968,916 | 11/1990 | Davenport et al. | 313/631 |

*Primary Examiner*—Donald J. Yusko
*Assistant Examiner*—Nimeshkumar D. Patel
*Attorney, Agent, or Firm*—George E. Hawranko; Stanley C. Corwin; Fred Jacob

[57] ABSTRACT

Anode and cathode means are provided for a metal halide lamp which cooperate in providing more rapid light output during lamp start-up. A xenon-metal halide lamp employing the improved discharge electrode means is disclosed along with an automotive headlamp having this lamp for its light source.

18 Claims, 3 Drawing Sheets

Fig. 1
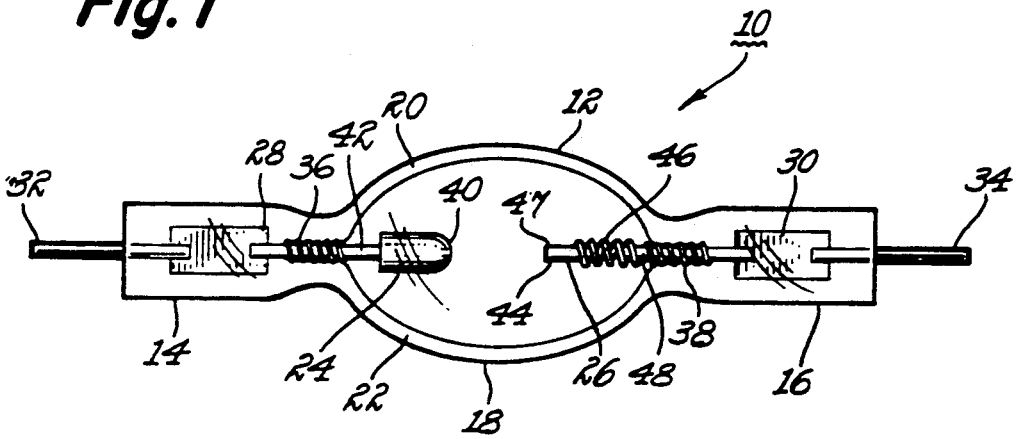
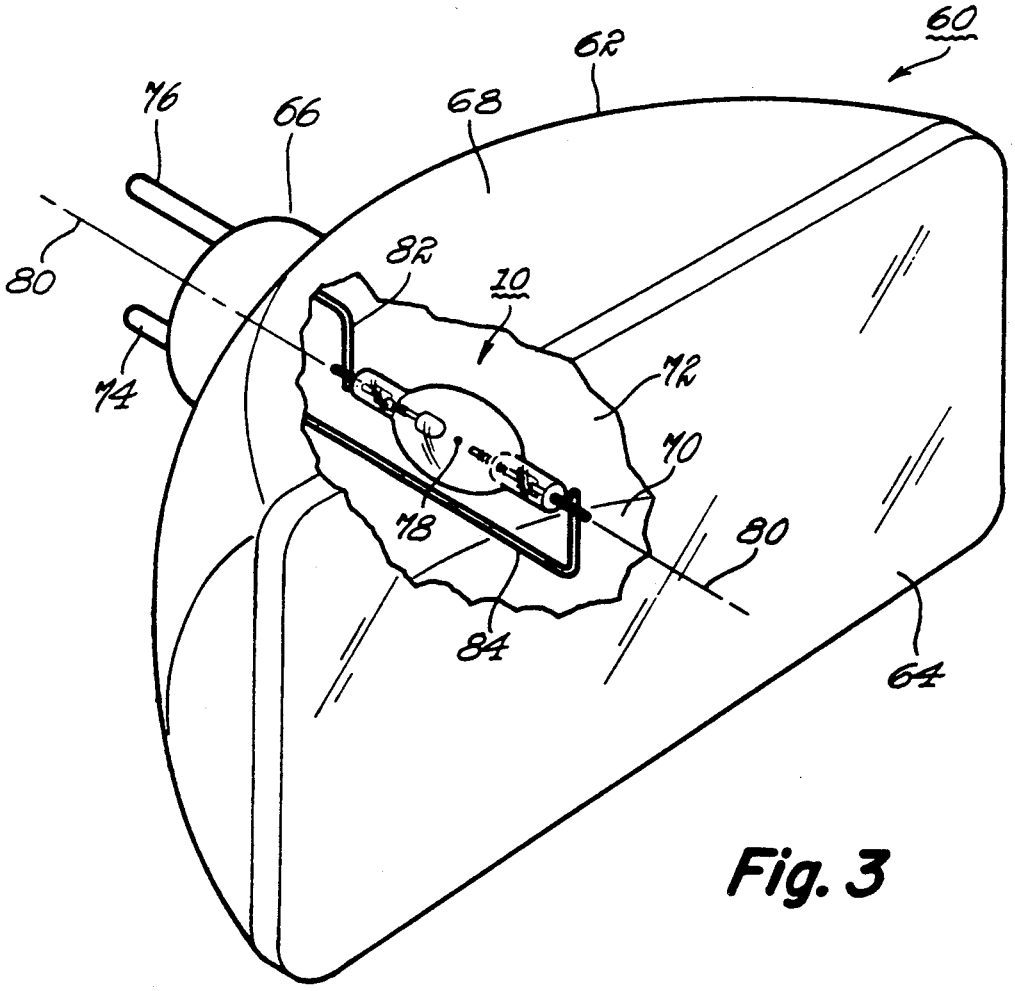
Fig. 3

INITIAL LIGHT OUTPUT FOR METAL HALIDE LAMP

RELATED PATENT APPLICATION

U.S. Pat. application Ser. No. 07/608,041 filed concurrently herewith entitled "HEAT SINK MEANS FOR METAL HALIDE LAMP" in the names of the present inventors discloses means for thermal management of a related metal halide lamp construction.

BACKGROUND OF THE INVENTION

This invention relates generally to means enabling faster light output from a metal halide discharge lamp and more particularly to a combination of anode and cathode means in a metal halide lamp promoting more rapid light output during lamp start-up.

Various metal halide discharge lamps commonly employ a fused quartz arc tube as the light source by reason of the refractory nature and optical transparency of this vitreous ceramic material. In such type lamps the arc tube generally comprises a sealed envelope formed with fused quartz tubing with discharge electrodes being hermetically sealed therein. A typical arc tube construction hermetically seals a pair of discharge electrodes at opposite ends of the sealed envelope although it is known to have both electrodes being sealed at the same end of the arc tube. The sealed arc tube further contains a fill of various metal substances which becomes vaporized during the discharge operation. The fill includes mercury and metal halides along with one or more inert gases such as krypton, argon and xenon. Operation of such metal vapor discharge lamps can be carried out with various already known lamp ballasting circuits employing either direct current or alternating current power sources.

For rapid sustained illumination with metal halide lamps, such as a xenon-metal halide lamp, a performance requirement now exists for at least fifty percent of the steady state light output to be reached within 0.75 seconds from the moment of lamp start-up. The prior art lamps experience significant light loss during start-up when the xenon discharge illumination is either absorbed or scattered by mercury which condenses upon the arc tube walls when first vaporized from the discharge electrodes. A "light hole" thereby results between the xenon illumination and less rapid illumination being produced by vaporization and ionization of the mercury and other metal ingredients further contained in the arc tube. By minimizing the light hole in these prior art lamps, a more sustained or continuous source of illumination is thereby provided. We have found considerably more mercury condensing on the conventional cathode electrodes than condenses on the conventional anode electrodes when these lamps are cooling down. The light hole occurs on the next lamp start when mercury is almost immediately vaporized from these cathode means which are also found to heat much faster than the conventional anode means. Recondensation of this vaporized mercury on still cooler arc tube walls during the lamp restart period produces a transitory light-blocking film which is located principally between the spaced-apart electrode means.

Accordingly, it is an object of the present invention to provide means whereby metal halide lamps experience less light loss during start-up.

Another object of the present invention is to provide an improved metal halide lamp employing a fused quartz arc tube as the light source which includes means for reduction of mercury condensation on the arc tube walls.

It is a still further object of the present invention to provide an improved automotive headlamp employing a metal halide lamp as the light source which experiences less light loss during start-up.

These and other objects of the present invention will become apparent upon considering the following more detailed description.

SUMMARY OF THE INVENTION

The present invention relates generally to providing more effective thermal management of mercury condensation within the lamp arc tube when a metal halide lamp is started or restarted. More particularly, the above defined light hole is reduced according to the present invention by means of employing a particular combination of anode and cathode means which significantly reduces the rate and maximum accumulation of mercury condensation on the arc tube walls at a location impeding light emergence from said arc tube. Suitable anode and cathode means enabling such above defined thermal management of mercury condensation during lamp cool-down and start-up can be provided in various ways. In one embodiment, both anode and cathode means comprise an electrode member connected to a refractory metal foil sealing element which is further connected to an outer lead conductor. Having the anode electrode member of such construction larger in physical size than the cathode electrode member has been found to retard vaporization of condensed mercury from the anode electrode member during lamp start-up due to its relatively large thermal mass and slower rate of warming. Regulation of heat conduction from the improved electrode members provides a further means to control the location of mercury condensation during lamp cool-down. For example, varying the physical size of the outer lead conductor connected to an electrode member has been found to alter the cooling rate of the electrode member connected thereto. Additionally, varying the amount of quartz material in that portion of the arc tube which is hermetically sealed to an electrode member has also been found to regulate heat conduction for the associated electrode member and thereby provide a still further means whereby condensation of mercury on the discharge electrodes can be controlled during lamp cool-down. Employment of the herein depicted anode and cathode arrangement enables the lamp starting current to be varied in a manner found to still further enhance the lamp light output.

BRIEF DESCRIPTION OF THE DRAWINGS

FIG. 1 is a side view depicting an arc tube for a metal halide lamp which incorporates anode and cathode means according to the present invention.

FIG. 3 a perspective view depicting an automotive headlamp incorporating the quartz arc tube of FIG. 1 oriented horizontally.

DETAILED DESCRIPTION OF THE PREFERRED EMBODIMENTS

Figure 2:
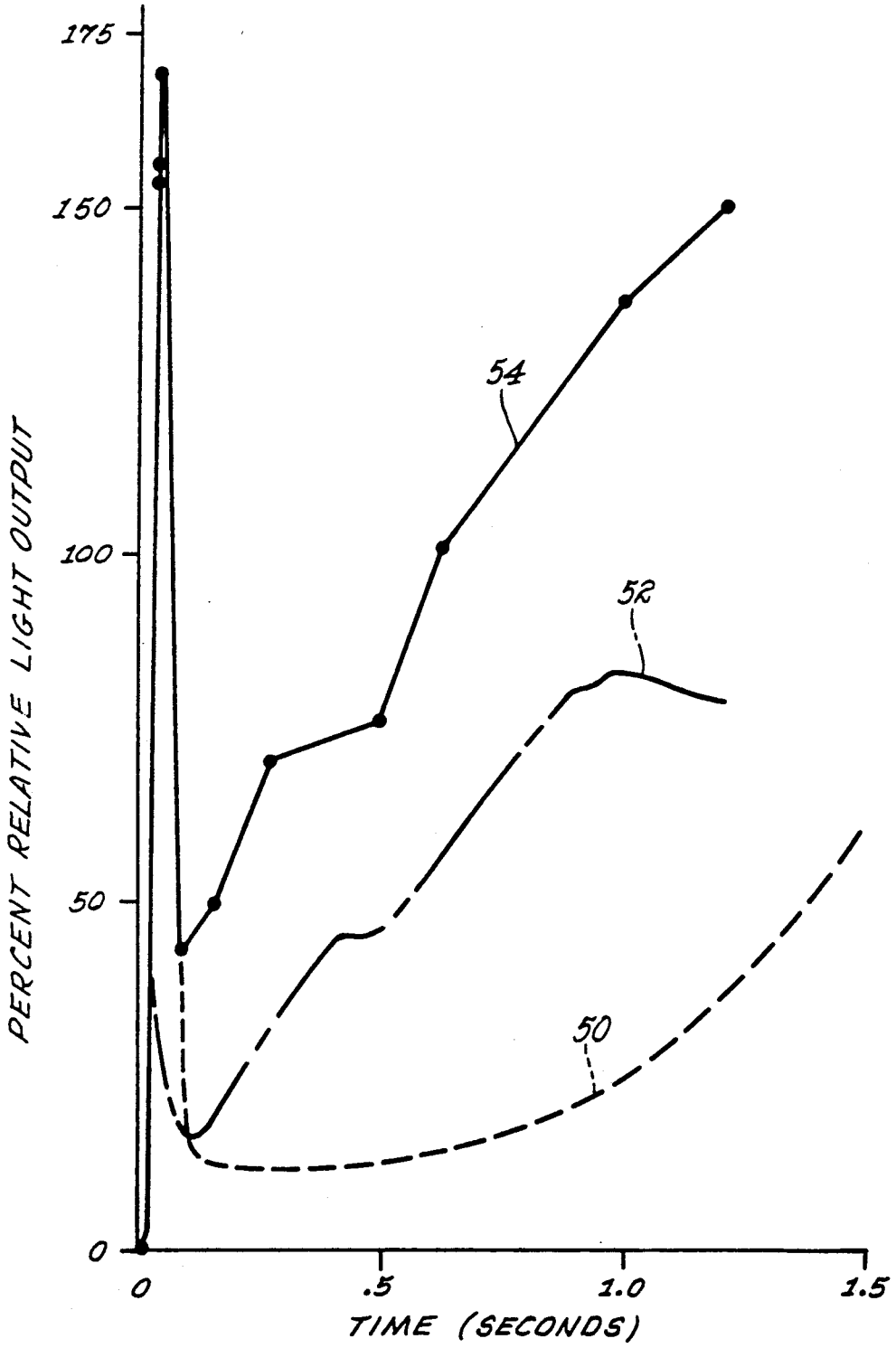
FIG. 2 is a graph illustrating the start-up mode of operation for improved arc tubes of the invention as compared with prior art arc tubes.

Referring to the drawings, FIG. 1 depicts a typical fused quartz arc tube 10 employing anode and cathode means according to the present invention. As shown in the drawing, the arc tube 10 has a double-ended configuration with an elongated hollow body 12 shaped to provide neck sections 14 and 16 at each end of a bulbous shaped central portion 18. The hollow body 12 may have typical overall dimensions in the range from about fifteen millimeters to about forty millimeters in length with a mid-point outer diameter from about six to about fifteen millimeters. Wall portions 20 and 22 of the hollow quartz body 12 hermetically seal a pair of discharge electrodes 24 and 26 at opposite ends of the bulbous mid-portion 18 which are separated from each other by a predetermined distance in the range from about two to about four millimeters. A single-ended arc tube configuration is also contemplated in accordance with the present invention wherein both electrodes are disposed at the same end of the arc tube and separated from each other by a predetermined spacing. Electrodes 24 and 26 both comprise rod-like members formed with a refractory metal such as tungsten or tungsten alloys and are configured to be of dissimilar physical size and shape for improved light output when operated with a direct current power source. The electrode members are also of the already known spot-mode type so as to develop a thermionic arc condition within said arc tube 10 in a substantially instantaneous manner. Both electrodes 24 and 26 are hermetically sealed within the quartz envelope 12 with thin refractory metal foil elements 28 and 30 that are further connected to outer lead wire conductors 32 and 34, respectively. A fill (not shown) of xenon, mercury and a metal halide is contained within the sealed hollow cavity 18 of the quartz envelope. Refractory metal coils 36 and 38 serve only to centrally position the electrode members at the ends of the sealed arc tube envelope.

Anode electrode member 24 is significantly larger in physical size than cathode electrode member 26 according to the invention and has a bullet shaped cylindrical distal end 40 sufficient in physical size to withstand a starting current without melting the refractory metal selected for its formation. The enlarged distal end 40 of the anode electrode member is joined to a refractory metal shank 42. Cathode electrode member 26 has a different construction with distal end 44 being formed with a refractory metal helix 46 which is joined at its outer terminal end to a first refractory metal shank 47 while being further joined at its inner terminal end to a second refractory metal shank 48.

During lamp start-up the uniquely designed anode and cathode electrodes provide for improved thermal management of mercury condensation Mercury is vaporized more slowly from the larger size distal end of the anode electrode member due to slower warming of its larger thermal mass. As a result, far less mercury condenses on the arc tube inner walls between the electrodes. Additional thermal management of mercury within the arc tube construction is provided by the particular cathode means being employed. The helical configuration forming part of the cathode electrode serves to lengthen the heat conduction path therein to afford another means for controlling thermal operation during lamp start-up and cool-down. Thus, a more rapid light output is observed with the herein depicted lamp embodiment whereby occurrence of the light hole is virtually eliminated.

Lamp tests conducted upon various 30 watt size instant light xenon-metal halide lamps are reported in FIG. 2 to establish the effectiveness of the present improvements. More particularly, the light output during lamp start-up was measured in lamps having the prior art construction as well as in lamps constructed according to the present invention. The prior art lamps reported in curve 50 employed a double-ended fused quartz arc tube having a bulbous shaped central cavity with a typical overall length in the range from about five millimeters to about fifteen millimeters and a mid-point inside diameter from about three to about ten millimeters. Identical "stick" or rod-type tungsten electrodes having an approximate 0.009 inch diameter were hermetically sealed at opposite ends of said arc tube cavity with a spaced-apart distance in the range of about two to four millimeters. The fill materials contained within the arc tube cavity included approximately 1.8 milligrams of a conventional halide mixture having approximately eighty percent by weight sodium iodide and approximately twenty percent by weight scandium oxide. Xenon gas at a fill pressure of approximately six atmospheres was further included in the arc tube cavity. Hermetic sealing of the discharge electrodes within the arc tube cavity was effected by connection to thin refractory metal foil elements further being connected to outer lead wire conductors having an approximate 0.015–0.016 inch diameter. The prior art lamp construction was operated with a conventional alternating current ballasting circuit delivering approximately four ampere starting current. As can be seen during the one second start-up time period shown in curve 50 of FIG. 1, the tested lamp construction experienced an almost instant xenon light peak followed by an immediate light hole to about a ten percent relative light output level. As further shown in curve 50, the prior art lamp did not achieve the desired fifty percent light output minimum level until approximately 1.4 seconds from the moment of lamp start-up. It was further observed during these lamp test measurements that mercury condensation occurred primarily on the cathode during lamp cool-down.

Similar unsatisfactory results were obtained upon a prior art lamp construction dissimilar only with respect to the particular anode means being employed. The modified anode employed a tungsten rod having approximately 0.016 inch diameter which terminated in a ball-end having approximately 0.040 inch diameter. The modified lamp was operated with a conventional direct current ballasting circuit delivering a starting current of approximately 5.5 amperes to detect any improvements found in the lamp operation. Again, this lamp construction experienced an almost immediate light hole from the xenon peak value to about a 10–15 percent relative light output level with the lamp recovering to the desired fifty percent light output level only after approximately 0.7 seconds. Correspondingly, mercury condensation was observed to occur primarily on the cathode during lamp cool-down.

Lamp test results for one xenon-metal halide lamp construction embodying the presently improved anode and cathode means are reported in curve 52. Only the anode and cathode means differed from the previously evaluated lamps with the discharge electrode means having the same type physical configuration disclosed in FIG. 1. As shown in FIG. 1, a "bullet" shaped tungsten alloy anode electrode member is hermetically sealed at one end of the arc tube cavity having a distal end approximately three millimeters in length and 0.040 inch in diameter. A smaller cathode electrode member is hermetically sealed at the opposite end of the arc tube cavity and consists of a tungsten alloy rod having a diameter of approximately 0.007 inch which is terminated at its distal end with a helix coil further being connected at the opposite end to a 0.009 inch diameter tungsten alloy shank tip. Constructing the cathode electrode member in such manner further reduces heat conduction therefrom for a less rapid cooling rate during lamp cool-down. When operated with a conventional direct current ballasting circuit again delivering a starting current of approximately 5.5 amperes, the improved lamp construction demonstrated the light output values reported in curve 52 during the start-up time period measured. As can be seen from the lamp test results, a minimum of twenty-seven percent light loss was experienced with recovery therefrom to the desired fifty percent light output level occurring in approximately 0.55 seconds. It can be further noted from a comparison of these results with those depicted by curve 50 that a faster rate of recovery in light output was also obtained from the improved lamp construction. Mercury condensation in the improved lamp construction was observed during those test measurements. Considerably more mercury now condensed on the anode during lamp cool-down with vaporization therefrom during subsequent lamp restart also being retarded.

Still further lamp light output improvement is demonstrated by curve 54 of FIG. 3. Such improvement was achieved by employing the lamp construction utilized in the immediately preceding improved lamp modified only to substitute larger size outer lead wire conductors. Increased cooling rates for the electrodes connected thereto is thereby obtained so as to further increase mercury condensation upon the anode electrode during lamp cool-down Accordingly, approximately 0.040 inch diameter outer lead wire conductors were substituted for the previously employed 0.015–0.016 inch diameter outer lead conductors. When operated with conventional direct current ballasting means at a starting current value of approximately 5.5 amperes, it can be noted from the reported lamp test results that the light hole barely reaches the fifty percent minimum light output level. Based upon these results it can be seen that a truly instant light output lamp has now been discovered achieving steady state light output almost from the moment of start-up.

Figure 4:
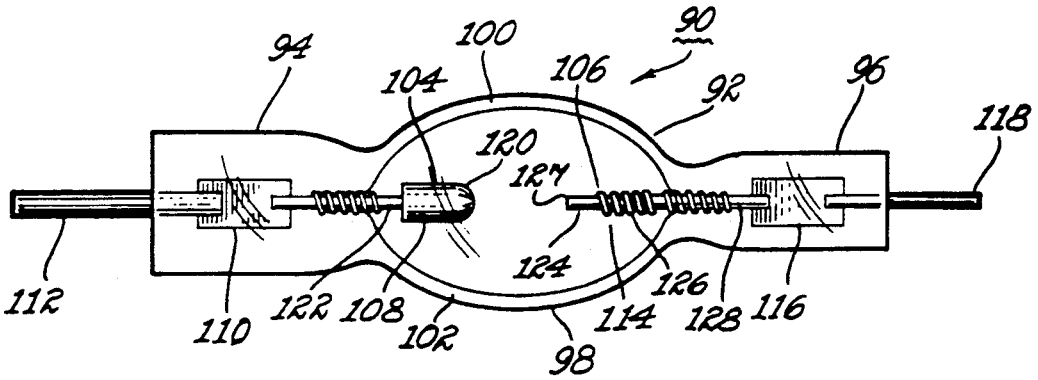
FIG. 4 a side view depicting a different physical configuration of a modified arc tube according to the present invention.

FIG. 3 is a perspective view depicting an representative automotive headlamp incorporating the quartz arc tube 10 of FIG. 1 being oriented in a horizontal axial manner. Accordingly, the automotive headlamp 60 comprises a reflector member 62, a lens member 64 secured to the front section of said reflector member, connection means 66 secured to the rear section of said reflector member for connection to a power source, and the hereinabove described metal halide light source 10. The reflector member 62 has a truncated parabolic contour with flat top and bottom wall portions 68 and 70, respectively, intersecting a parabolic curved portion 72. Connection means 66 of the reflector member includes prongs 74 and 76 which are capable of being connected to a ballast (not shown) which drives the lamp and which in turn is driven by the power source of the automotive vehicle. The reflector member 62 has a predetermined focal point 78 as measured along the axis 80 of the automotive headlamp 60 located at about the mid-portion of the arc tube 10. The arc tube 10 is positioned within the reflector 62 so as to be approximately disposed near its focal point 78. For the presently illustrated embodiment, the arc tube member 10 is oriented along axis 80 of the reflector. The reflector cooperates with the light source member 10 by reason of its parabolic shape and with lens member 64 affixed thereto being of optically transparent material which can include prism elements (not shown) also cooperating to provide a predetermined forward projecting light beam therefrom. Arc tube 10 is connected to the rear section of reflector 62 by a pair of relatively stiff self-supporting lead conductors 82 and 84 which are further connected at the opposite end to the respective prong elements 74 and 76. Since it will be apparent to those skilled in the art that still other structural arrangements can be found for suitably orienting the presently modified lamp in other already known reflector designs, it is not intended to limit such headlamp configurations to the herein illustrated embodiment FIG. 4 is a side view depicting a different fused quartz arc tube construction 90 employing anode and cathode means embodying the concepts of the present invention. Accordingly, the arc tube construction employs a double-ended hollow quartz body 92 providing neck sections 94 and 96 at each end of a bulbous shaped central cavity 98. Wall portions 100 and 102 of the hollow quartz body 92 hermetically seal anode and cathode means 104 and 106, respectively, at opposite ends of the bulbous mid-portion 98. Anode means 104 again comprises an electrode member 108 hermetically sealed within the hollow cavity 98 with a thin refractory metal sealing element 11O which is connected at the opposite end to outer lead conductor 112. Similarly, cathode means 106 also employ an electrode member 114 hermetically sealed within the opposite end of hollow cavity 98 by a refractory metal sealing element 116 with the opposite end of the sealing element being connected to outer lead conductor 118. Anode electrode member 108 is also again of significantly larger physical size than cathode electrode member 114 to provide a greater thermal mass during lamp start-up in accordance with the practice of the present invention and with both of the refractory electrodes being formed with tungsten metal. Anode electrode member 108 again has a bullet shaped distal end 120 being joined to a tungsten metal shank 122. Cathode electrode member 114 has a distal end 124 formed with a tungsten metal helix 126 again joined at opposite terminal ends to tungsten shanks 127 and 128. As can be further seen, different heat conduction means have been provided in the arc tube construction which enable anode means 104 to cool more rapidly when the lamp is turned off. Outer lead conductor 112 has a larger diameter for this purpose and a larger diameter neck portion 94 at the anode end of the hollow envelope 92 further assists cooling by additional quartz material being provided. By increasing thermal conduction in such manner, the anode means warms more slowly during lamp start-up to produce less mercury condensation on the arc tube walls impeding light emergence, and during cool-down, mercury deposition on the anode is increased.

Still other heat conduction means are contemplated for proper thermal management of mercury condensation within the arc tube during lamp operation. For example, decreasing quartz material at the cathode end of the arc tube can desirably reduce mercury condensation on the cathode means during lamp cool-down. Preferential cooling of the anode means in the depicted arc tube construction can also be achieved by decreasing the insertion distance for anode electrode member 108 into the arc tube cavity 98. Such selective electrode displacement increases heat conduction from the hotter electrode member to the cooler arc tube walls. Additionally, the heat sink means disclosed in the aforementioned concurrently filed Ser. No. 07/608,091 application can be employed for placement adjacent the anode means of the herein illustrated arc tube member to still further assist in obtaining a preferential rate of electrode cooling when the lamp is turned off. Placement of such heat sink means intermediate the spaced-apart electrodes ca further adjust the thermal balance between said electrodes so as to desirably enhance mercury condensation on the anode during lamp cool-down.

Figure 5:
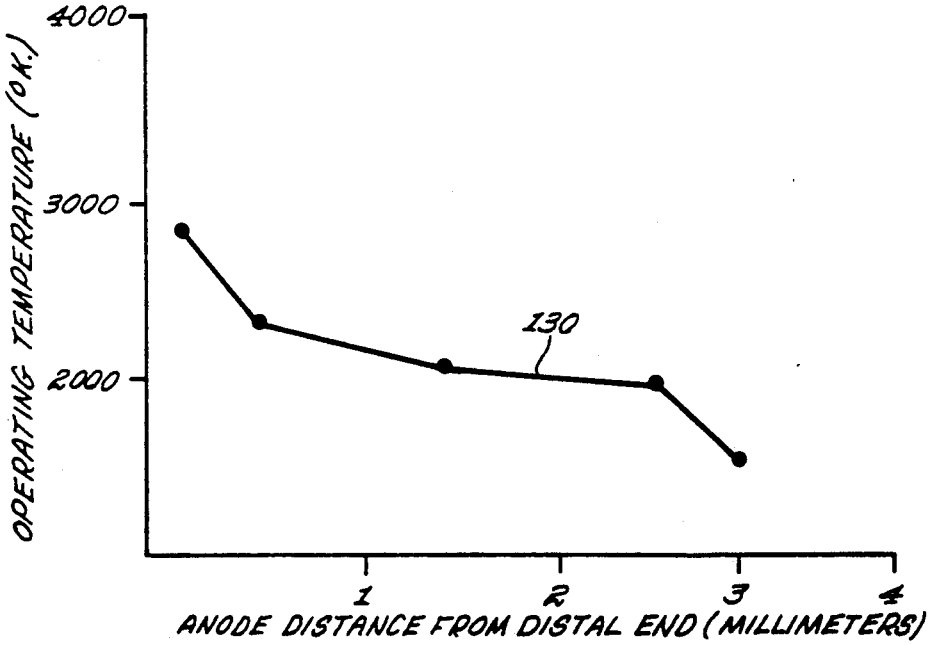
FIG. 5 is a graph representing a temperature profile obtained from the anode member during lamp start-up for the arc tube of FIG. 1.

FIG. 5 shows a graph representing the temperature profile obtained at distal end 40 of the anode electrode member in FIG. 1 The anode was constructed with tungsten metal having a 0.040 inch diameter distal end butt-welded to a 0.016 inch tungsten shank. The distal end of the anode measured approximately 0.098–0.138 inch in length with a radius tip at its bullet-end measuring approximately 0.010 inch. To make the temperature measurements, arc tube 10 contained only a xenon fill at approximately four atmospheres fill pressure and was started at a lamp current of approximately 6.0 amperes applied for approximately 700 milliseconds. Temperatures were measured at four locations along the electrode distal end starting at the radius tip with temperatures being recorded after approximately 300 milliseconds from lamp start-up as shown on the depicted graph 130. The temperature reached at the tip end of the electrode can be seen to approach the tungsten melting temperature at the starting current level herein being employed.

It will be apparent from the foregoing description that particular means have been provided to more effectively exercise thermal management of mercury condensation in metal halide lamps. It will be apparent that further modification can be made in physical features of the anode and cathode means herein illustrated, however, without departing from the true spirit and scope of the present invention. Configurations of a fused quartz arc tube, electrode members and reflector lamp designs other than illustrated herein are also contemplated. For example, an automotive headlamp having the light source aligned transverse to the lamp axis and which includes the present anode and cathode means is contemplated. Consequently, it is intended to limit the present invention only by the scope of the appended claims.

What we claim as new and desire to secure by Letters Patent of the United States is:

1. A Metal halide lamp experiencing low light loss during lamp start-up which comprises in combination:

(a) a fused quartz arc tube having a hollow cavity hermetically sealing spaced-apart refractory metal anode and cathode means therein and further containing a fill of mercury, a metal halide and an inert gas at a relatively high fill pressure, (b) the cathode means having a dissimilar structural configuration and being smaller in size relative to the anode means so as to exhibit a more rapid heating rate than the anode means during lamp start-up while further exhibiting a less rapid cooling rate than the anode means during lamp cool-down and (c) first and second outer lead connector elements associated with said anode and said cathode means respectively; said first outer lead connector being larger in size than said second outer lead connector and said first outer lead convertor further being supported by a portion of said arc tube which is larger than a corresponding portion of said arc tube that supports said second outer lead connector.

2. The lamp of claim 1 wherein the anode means has a different physical shape than the cathode means.

3. The lamp of claim 1 wherein an increased starting current level increases the rate of light recovery during lamp start-up.

4. The lamp of claim 1 wherein the minimum light output level during lamp start-up is greater.

5. The lamp of claim 4 wherein the minimum light output level is greater and the recovery rate from the minimum light output level is more rapid.

6. The lamp of claim 1 wherein the anode means exhibits more rapid heat conduction therefrom than the cathode means.

7. The lamp of claim 1 wherein the anode means and cathode means each comprise an electrode member connected to a refractory metal foil sealing element which is further connected to an outer lead conductor.

8. The lamp of claim 7 wherein the anode electrode member is significantly greater in thermal mass than the cathode electrode member.

9. A xenon-metal halide lamp experiencing low light loss during lamp start-up which comprises:

(a) a fused quartz arc tube having a hollow cavity hermetically sealing a pair of spaced-apart refractory metal discharge electrodes therein and further containing a fill of mercury, a metal halide and xenon gas at a relatively high fill pressure, (b) the discharge electrode serving as the cathode having a dissimilar structural configuration and being smaller in size relative to the discharge electrode serving as the anode so as to exhibit a more rapid heating rate during lamp start-up while further exhibiting a less rapid cooling rate than the discharge electrode serving as the anode during lamp cool-down and (c) first and second outer lead connector elements associated with said anode and said cathode means respectively; said first outer lead connector being larger in size than said second outer lead connector and said first outer lead convertor further being supported by a portion of said arc tube which is larger than a corresponding portion of said arc tube that supports said second outer lead connector.

10. The lamp of claim 9 wherein both discharge electrodes have a rod-like configuration, the anode electrode having an enlarged refractory metal distal end joined to a refractory metal shank and the cathode electrode having a distal end formed with a refractory metal helix joined at each end to a refractory metal shank.

11. The lamp of claim 9 wherein both anode and cathode electrodes are constructed with tungsten metal.

12. The lamp of claim 9 wherein the discharge electrodes are disposed at opposite ends of the arc tube.

13. The lamp of claim 9 wherein the arc tube includes a bulbous shaped central portion.

14. The lamp of claim 9 wherein the xenon gas fill pressure is at least four atmospheres.

15. The lamp of claim 9 wherein the distal end of the anode electrode has a cylindrical contour with larger diameter and length than the distal end of the cathode electrode.

16. An automotive headlamp which comprises:

(a) a reflector member for connection to a power source, the reflector member having a predetermined focal length and focal point, (b) a lens member joined to the front section of the reflector, and (c) a fused quartz arc tube predeterminently positioned within said reflector so as to be approximately disposed adjacent the focal point of the reflector and experiencing low light loss during lamp start-up, the fused quartz arc tube having a hollow cavity hermetically sealing spaced-apart refractory metal anode and cathode means therein and containing a fill of xenon at a relatively high fill pressure, mercury and a metal halide, the cathode means having a dissimilar structural configuration and being smaller in size relative to the anode means so as to exhibit a more rapid heating rate than the anode means during lamp start-up while further exhibiting a less rapid cooling rate than the anode means during lamp cool-down and (d) first and second outer lead connector elements associated with said anode and said cathode means respectively; said first outer lead connector being larger in size than said second outer lead connector and said first outer lead connector further being supported by a portion of said arc tube which is larger than a corresponding portion of said arc tube that supports said second outer lead connector.

17. The automotive headlamp of claim 16 wherein the reflector has a parabolic configuration.

18. The automotive headlamp of claim 15 wherein the lens includes prism elements.

* * * * *